US006739490B1

(12) United States Patent
Shkolnikov et al.

(10) Patent No.: US 6,739,490 B1
(45) Date of Patent: May 25, 2004

(54) FASTENER SUPPLY AND POSITIONING MECHANISM FOR A TOOL

(75) Inventors: Yury Shkolnikov, Glenview, IL (US); John M. Rotharmel, Palatine, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/178,203

(22) Filed: Jun. 24, 2002

(51) Int. Cl.[7] ..... B27F 7/00
(52) U.S. Cl. ..... 227/2; 227/109; 227/119
(58) Field of Search ..... 227/2, 109, 119, 227/120, 136

(56) References Cited

U.S. PATENT DOCUMENTS

| | | | | |
|---|---|---|---|---|
| 3,837,556 A | * | 9/1974 | Doyle et al. | 227/136 |
| 4,928,867 A | * | 5/1990 | Jensen | 227/7 |
| 5,052,607 A | * | 10/1991 | Dutton | 227/107 |
| 5,163,596 A | | 11/1992 | Ravoo et al. | |
| 5,238,167 A | * | 8/1993 | Howard et al. | 227/110 |
| 5,437,404 A | | 8/1995 | Shkolnikov | |
| 5,452,835 A | * | 9/1995 | Shkolnikov | 227/8 |
| 5,562,240 A | * | 10/1996 | Campbell | 227/130 |
| 5,592,580 A | | 1/1997 | Doherty et al. | |
| 5,794,831 A | * | 8/1998 | Velan et al. | 227/2 |
| 5,911,350 A | * | 6/1999 | Bolger et al. | 227/2 |
| 6,123,241 A | | 9/2000 | Walter et al. | |

FOREIGN PATENT DOCUMENTS

| | | |
|---|---|---|
| EP | 1 005 958 A | 6/2000 |
| WO | 02 16085 A | 2/2002 |

* cited by examiner

*Primary Examiner*—Scott A. Smith
*Assistant Examiner*—Chukwurah Nathaniel
(74) *Attorney, Agent, or Firm*—Lisa M. Soltis; Mark W. Croll; Donald I. Breh

(57) ABSTRACT

A tool for driving fasteners into a workpiece includes a fastener supply device removably attachable to the tool and supplying the fasteners to the channel, and a workpiece contact element. There is a first alignment mechanism on the nosepiece and a second alignment mechanism on the workpiece contact element. A threaded adjusting member located on the workpiece contact element and a threadable adjustable mechanism on the nosepiece are configured engage with each other, such that movement of the workpiece contact element due to rotation of the threadable adjustable mechanism causes the first alignment mechanism to engage the second alignment structure. The tool has a sensor held by the housing and a detector within the fastener supply configured to sense the length of the fasteners and communicate the length to the sensor.

20 Claims, 5 Drawing Sheets

FASTENER SUPPLY AND POSITIONING MECHANISM FOR A TOOL

CROSS REFERENCE TO RELATED APPLICATIONS

This application is related to U.S. Ser. No. 10/241,177 herewith, entitled "An Improved Power Control System for a Tool"

BACKGROUND OF THE INVENTION

This invention relates to portable combustion powered fastener driving tools, and more specifically to a system for varying the power output to such a tool.

Portable combustion powered tools for use in driving fasteners into workpieces are described in commonly assigned patents to Nikolich, U.S. Pat. Nos. Re. 32,452; 4,403,722; 4,483,473; 4,483,474; 4,552,162; 5,197,646 and 5,263,439, all of which are incorporated herein by reference. Such combustion powered tools particularly designed for trim applications are disclosed in commonly assigned U.S. Pat. No. 6,016,622, also incorporated by reference herein. Similar combustion powered nail and staple driving tools are available from ITW—Paslode under the IMPULSE® brand.

Such tools incorporate a generally pistol-shaped tool housing enclosing a small internal combustion engine. The engine is powered by a canister of pressurized fuel gas also called a fuel cell. A battery-powered electronic power distribution unit or electronic sending unit produces the spark for ignition, and a fan located in the combustion chamber provides for both an efficient combustion within the chamber, and facilitates scavenging, including the exhaust of combustion by-products. The engine includes a reciprocating piston having an elongate, rigid driver blade disposed within a piston chamber of a cylinder body.

A wall of the combustion chamber is axially reciprocable about a valve sleeve and, through a linkage, moves to close the combustion chamber when a workpiece contact element at the end of a nosepiece, or nosepiece assembly, connected to the linkage is pressed against a workpiece. This pressing action also triggers the introduction of a specified volume of fuel gas into the combustion chamber from the fuel cell.

Upon the pulling of a trigger, which causes the ignition of the. gas in the combustion chamber, the piston and the driver blade are shot downward to impact a positioned fastener and drive it into the workpiece. As the piston is driven downward, a displacement volume enclosed in the piston chamber below the piston is forced to exit through one or more exit ports provided at a lower end of the cylinder. After impact, the piston then returns to its original or "ready" position through differential gas pressures within the cylinder. Fasteners are fed into the nosepiece barrel from a supply assembly where they are held in a properly positioned orientation for receiving the impact of the driver blade. The fasteners are then propelled through the length of the barrel by the driver blade, exiting the barrel at the workpiece surface. Force of the driver blade and the momentum of the fastener drive the fastener to penetrate the workpiece.

There is considerable shock and vibration that is absorbed by the tool with each firing of the combustion chamber. Rapid movement of the piston within the cylinder due to the expansion of combustion gases and the force. of the driver blade on the workpiece tend to propel the tool away from the fastener as it is driven into the workpiece. Immediately following firing of the tool, the hot, expanded gases are purged from the combustion chamber, the cylinder rapidly contracts, drawing the driver blade back up into the tool within a fraction of a second, tending to recoil and propel the tool in the opposite direction. These forces put large stresses on the housing and all parts of the tool, causing wear where materials flex or parts abrade on each other.

Stresses as described above are particularly acute when short fasteners are driven by the tool. In many applications, long nails are used predominantly. When driving long nails, more of the force from the power source and exerted through the driver blade is absorbed by the nail as it penetrates the workpiece. As the fastener is driven deeper, additional force is needed to overcome friction between the fastener and the workpiece as the surface area between the two surfaces increases. Short fasteners require less force to completely penetrate the workpiece, so the excess power is absorbed by both the user and the tool. In the extreme, a blank fire, whereby the tool is fired when no fastener is present to absorb any of the shock, puts tremendous stress on the tool, possibly shortening the useful life of the tool.

Control of energy output to a combustion-powered tool is disclosed in U.S. Pat. No. 5,592,580 to Doherty et al., herein incorporated by reference. A voltage divider includes a settable resistance, either a potentiometer or two parallel, fixed resistances that can be alternatively selected, and is used to provide a setpoint voltage. This patent also discloses changing the fan speed in response to light transmission between a phototransmissive diode and a photoreceptive transistor. Thus, it discriminates between fasteners of various lengths, and selected the voltage to the fan depending on the position of the photoelectric switches.

However, reduction in fan speed alone has been unsuccessful in producing a tool that fires consistently at low power. Use of the fan to exhaust the combustion products serves two primary purposes. It produces turbulence in the vicinity of the combustion chamber, promoting heat transfer to cool the tool after firing, as well as mixing of the combustion gases with fresh, oxygenated air. Mere reduction in the fan speed limits both the cooling and replenishment of oxygen in the combustion chamber. When combustion products remain in the combustion chamber in the subsequent combustion cycle, the fuel-to-air ratio may become difficult to control. After several firings, tools running at a low fan speed can have insufficient oxygen to support combustion.

The use of a metering valve to control the flow of fuel into the chamber is disclosed in U.S. Pat. No. 5,752,643 to MacVicar et al. and in U.S. Pat. No. 6,123,241 to Walter et al. This invention teaches the use of the metering valve to control the fuel-to-air ratio more precisely to improve the efficiency of combustion. However, use of metering valves with high pressure fluids used in very small quantities are difficult to control.

Thus, there is a need in the art for a power tool that is able to efficiently reduce the primary power expended when short nails are in use. There is also a need for a tool that varies the power expenditure automatically, without the need to change settings or switches by the user. In a tool that varies the primary power by changing the fan speed, there is an additional need for an improved system for evacuating the combustion gases following combustion so that they do not built up, interfering with proper fuel to air ratios for efficient combustion.

SUMMARY OF THE INVENTION

These and other needs are met or exceeded by the present invention which features an improved system for positioning a tool on a workpiece for precise placement of the fasteners and automatically adjusting the power output of a tool based upon the length of the fastener.

More specifically, the present invention provides a tool for driving fasteners into a workpiece, including a housing, a nosepiece at least partially defining a channel through which fasteners are expelled, a fastener supply removably attachable to said tool and supplying the fasteners to the channel, and a workpiece contact element. There is a first alignment mechanism on the nosepiece and a second alignment mechanism on the workpiece contact element. The second alignment mechanism engages the first mechanism for alignment to maintain alignment between the workpiece contact element and the nosepiece. A threaded adjusting member located on the workpiece contact element and a threadable adjustable mechanism on the nosepiece are configured engage with each other, such that movement of the workpiece contact element due to rotation of the threadable adjustable mechanism causes the first alignment mechanism to engage the second alignment structure.

The tool has a sensor held by the housing and a detector within the fastener supply configured to sense the length of the fasteners and communicate the length to the sensor. One embodiment is the detector is a lever that rotates in response to a force exerted by fasteners that exceed a predetermined length.

The tool described above allows for more precise placement of fasteners using a workpiece contact element that is easily interchangeable with standard workpiece contact elements, but is held securely on the nosepiece. Consistent placement of the fasteners requires, in part, that the workpiece contact element housing not move relative to the nosepiece during firing of the tool. Configuration of the present workpiece contact element limits movement of the apparatus in several directions while keeping installation fast and simple.

Further, the present method and apparatus also automatically adjusts for the length of the fastener. A detector on the tool provides an signal as to the fastener length that is used to vary the power. The tool is saved from wear and tear due to stresses absorbed when small fasteners or blanks are fired. Reduction of power reduces the materials that flex or abrade on each other when fired. The present system does not require the user to remember to change a setting or manipulate a manual lever when changing to a magazine with differently sized fasteners.

DETAILED DESCRIPTION OF THE INVENTION

Figure 1:
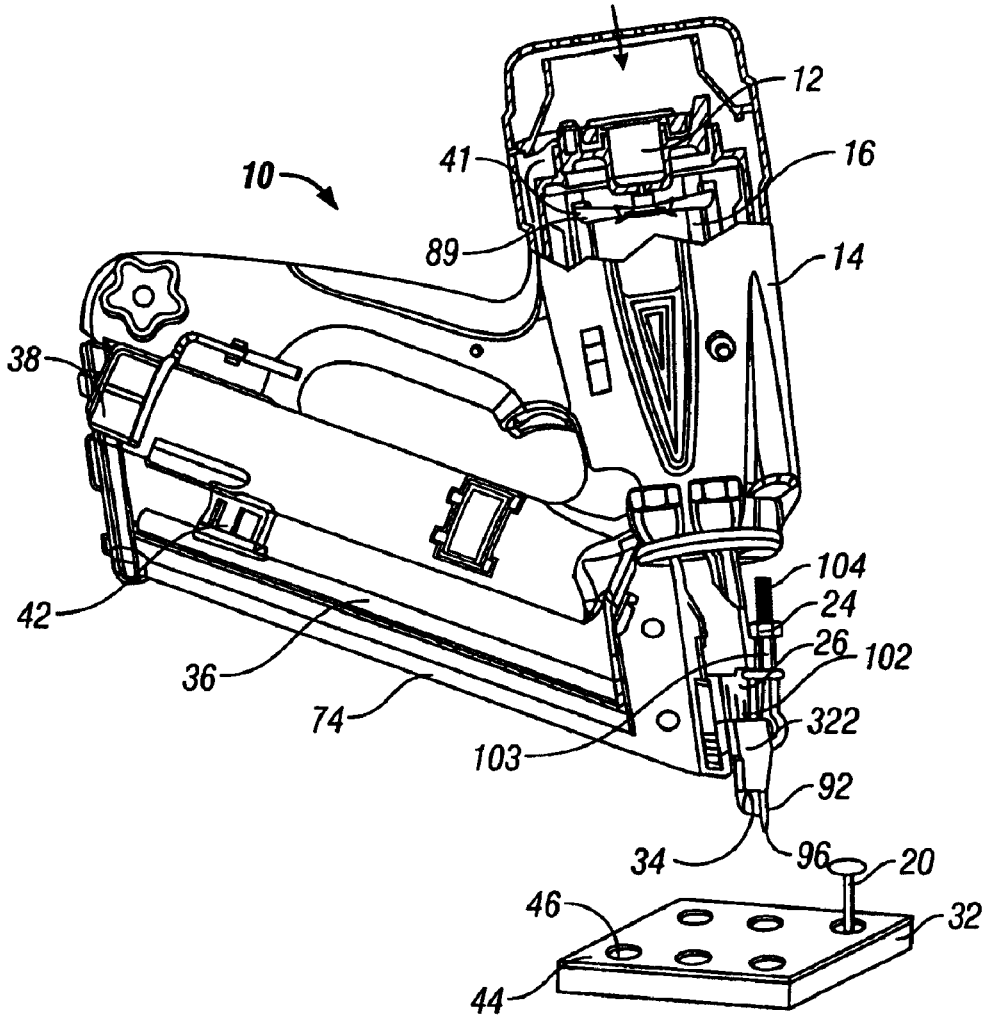
FIG. 1 is a perspective drawing of the present tool with the alternate embodiment of the workpiece contact element, with a portion of the housing cut away to show the fan and combustion chamber.

Referring to FIG. 1, a power tool, generally designated 10, is designed to utilize a plurality of power levels from a combustion by reducing the power to a fan motor 12 prior to firing of the tool, then returning it to full power immediately following combustion. The power tool 10 for use with the present power control system includes a housing 14 and a combustion chamber 16, that produces primary power to drive fasteners 20, held within the housing. A workpiece contact element 22, adjustably threadable to a threadable adjustment mechanism 24 on a nosepiece 26, moves to close the combustion chamber 16 through a linkage (not shown) when the workpiece contact element 22 is pressed against a workpiece 32. The fasteners 20 are fed to a channel 34 at least partially defined by the nosepiece 26 from a supply assembly 36, such as a removably attachable magazine. A power control system, the interchangeable nosepiece 26 and components of the work contact element 22 enable the tool 10 to be converted conveniently for use with a plurality of different types of fasteners 20. Directional references used herein are to be interpreted when the tool 10 is oriented as in FIG. 1 and are not intended to limit the invention in any way.

Figure 2:
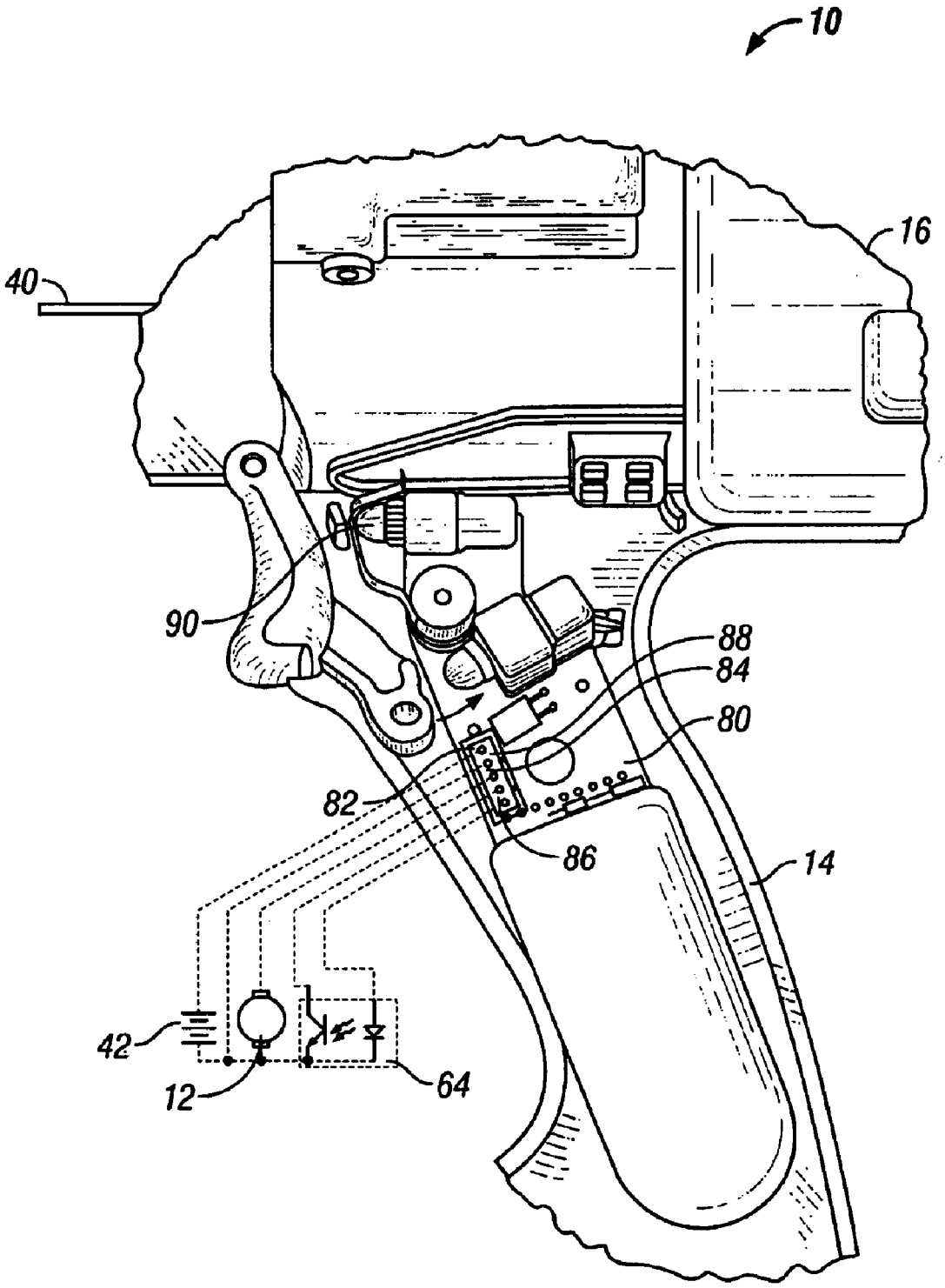
FIG. 2 is a fragmentary side view of a portion of the circuit board of the tool of FIG. 1, with the electrical connections to the battery, the fan motor and magazine sensor represented schematically.

Referring now to FIGS. 1 and 2, fuel is provided to the combustion chamber 16 from a fuel cell 38 and mixed with air in an appropriate ratio. When the tool 10 is fired, the mixture in the combustion chamber 16 is ignited and rapidly burned, generating carbon dioxide, water vapor and other gases under high pressure. The gases push on a piston (not shown), pushing it downward and driving an attached driver blade 40 to contact a fastener 20 in the channel 34 and expel it from the channel. Following combustion, the spent combustion gases are purged from the combustion chamber 16 in preparation for the next firing using a fan 41 driven by the fan motor 12, which is powered by a secondary power source, such as a battery 42, in the vicinity of the combustion chamber.

Several different types of fasteners 20 are used with power tools 10. Frequently, the fasteners 20 are nails having round heads, square heads or clipped head nails, also known as "D" shaped heads. For the fasteners 20, the use of the nails with either the heads centered or offset on a shank are contemplated. Offset, round head or clipped nails are a first type of fastener 20 that is commonly used in, i.e., when directly connecting two pieces of wood. A second type of the fastener 20, used frequently with metal strapping or support brackets 44 having prepositioned openings 46, is a full round head, hardened nail, such as Positive Placement® nails by ITW—Paslode of Glenview, Ill. These two fastener types are discussed herein as examples of the fasteners 20 with which this invention is used, and are not intended to limit this invention, in that any type of fastener which may be driven by the tool 10 is suitable for the present invention.

The present power control system automatically varies the primary power to the tool 10 prior to driving the fastener 20 and returning to full power following driving of the fastener, whereby the power varies in relation to the length of the fastener. Discrimination between the fasteners 20 that are driven with full power compared to those driven with reduced power is determined by many factors. For most situations, 1½ inch nails 20 can be driven with approximately 50% power compared with nails of about 2½ to 3 inches. For convenience of discussion, 1½ inch nails are referred to as short fasteners 20 while 2½ to 3 inch nails are known as long fasteners. For the purposes of this discussion, only two fastener lengths, short and long, will be considered, however it is contemplated that any number of possible distinctions in fastener lengths are suitable.

Figure 3:
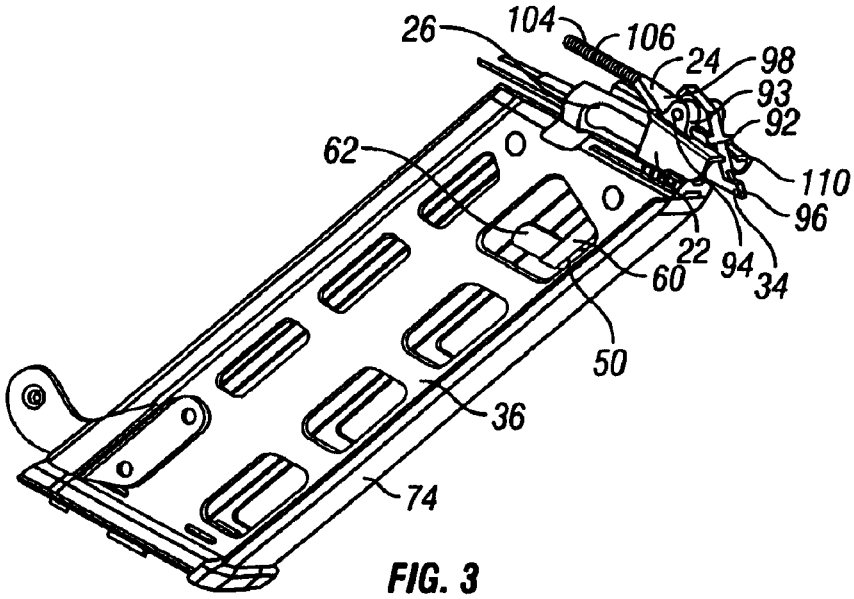
FIG. 3 is a perspective view of the magazine, nosepiece and workpiece contact element.

Turning to FIG. 3, a detector 50 in the magazine 36 senses the length of the fastener 20. In one embodiment, the detector 50 is mechanical, such as a pivoting lever. The lever 50 is selectively displaced depending on the length of the fastener 20. While several suitable mechanical detectors 50 are discussed in detail below, this invention is not to be construed as to being limited to mechanical detectors 50. Optical detectors, infrared detectors, magnetic, sonic, or any other type of detector 50 is suitable that can discriminate between fasteners 20 having different lengths compared to a predetermined length.

The lever-type detector 50 discussed above is shown in detail in FIGS. 4 and 5. The detector 50 includes a lever arm 52 and a pin 54. A pivot ring 56 surrounds the pin 54 and provides a point about which the lever arm 52 freely rotates. Projecting from one side of the pivot ring 56, there is an actuating arm 60 supporting an offset plate 62. The plate 62 is in registry with, and contacts a sensor 64 on the tool 10. Opposite the actuating arm 60 is a sensing arm 66, which includes a channel face 70 and a positioning face 72. At least a portion of the positioning face 72 extends into the path of the long fasteners 20. The lever arm 52 is positioned at a bottom 74 of the magazine 36 so that all of the fasteners 20 easily pass over the actuating arm 60 as they move toward the channel 34. A top surface 76 of the sensing arm 60 slopes upwardly toward the fasteners 20 from the pivot ring 56 to the channel face 70. The maximum height of the sensing arm 60 at the channel face 70 is governed by the predetermined length of the fastener 20 that the detector 50 is intended to distinguish. The sensing arm 60 of this embodiment must be tall enough to contact the fastener 20 of a predetermined length as it passes over the lever 52.

Figure 4:
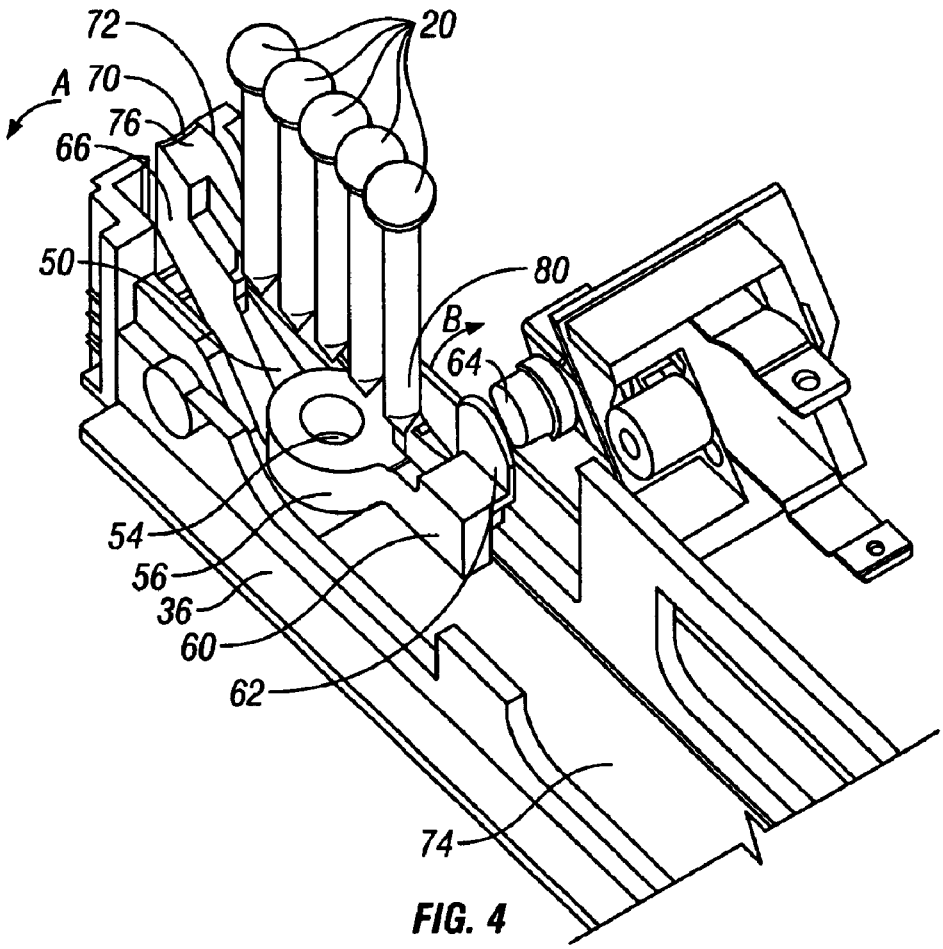
FIG. 4 is a fragmentary view of a portion of the magazine and the sensor showing the interaction between the lever and the sensor, with the lever in the first position.

As seen in FIG. 4, the lever 52 is in a first position. When the sensor 64 is a push button that is biased toward the magazine 36, the biasing force generated by the button holds the lever 52 in this position. Optionally, the button 64 is shielded by a strip of spring steel (not shown) between the button and the magazine 36. The strip protects the button 64 during installation and removal of the magazine 36 and provides an additional biasing force toward the magazine if needed. In this position, the short fasteners 20 pass over the lever 52 entirely and enter the channel 34 without contacting the lever.

However, when long fasteners 20 are used, a portion of the fastener contacts the positioning face 72 of the lever 52, moving it to a second position. A lower portion 80 of the fastener 20 pushes against the positioning face 72 of the sensing arm 66, causing it to pivot in the direction indicated by arrow A. In this position, the channel face 70 moves from blocking a portion of the channel 34, to a position allowing the long fasteners 20 to pass. Pushing the sensing arm 66 in direction A causes the lever 52 to pivot about the pin 54, pushing the actuating arm 60 in the opposite direction as indicated by arrow B. This movement pushes the plate 62, which is already in registry with the button 64, against the button, overcoming the biasing force exerted by the button against the plate and causing it to be actuated.

Figure 5:
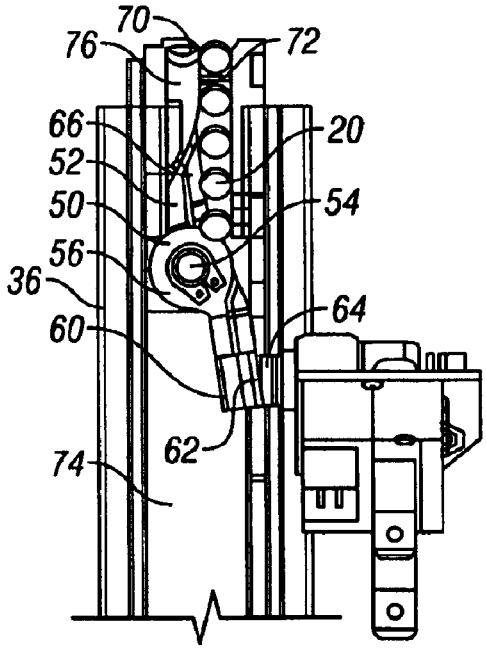
FIG. 5 is a top view of the magazine and sensor of FIG. 4 with the lever in the second position.
Figure 6:
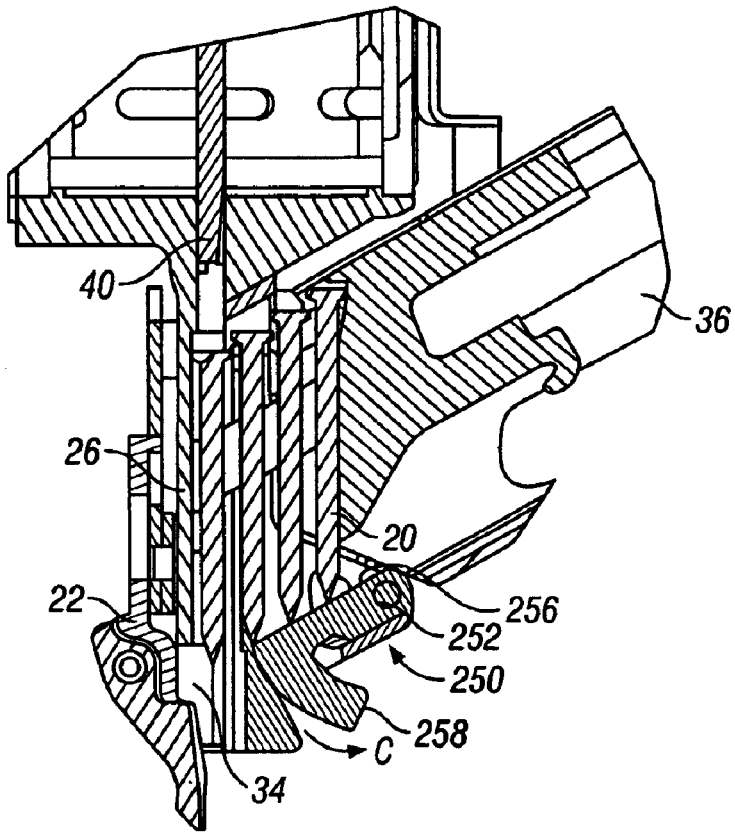
FIG. 6 is a fragmentary, vertical cross-sectional view of a magazine and nosepiece showing an alternate embodiment of the detector.

A second embodiment 250 of the detector is seen in FIG. 6. Working in basically the same fashion as the detector 50 of FIGS. 4 and 5, the detector 250 moves in a direction C, pivoting about a point 252 on one end of the detector rather than a central pivot point. In this case, the detector 250 is spring biased upward, toward the fasteners 20. The short fasteners 20 do not move the detector 250, leaving the detector in a first position. But when the long nails pass by it, they push the sensing face 256 of the detector 250 down to a second position shown in FIG. 6. The sensor 64 (not shown) occupies any suitable location where it can be actuated by the detector 250. Preferably, the sensor 64 is located below the first position of the detector 250, so that it is triggered by an actuating face 258 of the detector when the it moves from the first position to the second position.

In yet a third embodiment (not shown), alternate yet equivalent of the detector 50, the detector pivots about a point and rotates, but the actuating face operates a cam linkage to a plate. The cam linkage transforms movement of the detector through the vertical plane to lateral motion by the plate, so that depression of the detector by long nails causes the sensor button to be depressed by the plate.

Referring to FIGS. 2 and 4, the detector 50 sends a signal to communicate to the sensor 64 information in response to the length of the fastener 20 in the magazine 36. The sensor 64 then communicates the fastener length to a controller 82. It is contemplated that the absence of a signal is one particular type of signal. Suitable types of the signal generating devices that are useful with this type of invention include mechanical linkages, electrical signals, optical signals, sounds, and the like. In the embodiment of the tool 10 shown here, the detector 50 is the lever 52 that is biased to a first position by the button 64 and rotates to a second position when the fasteners 20 are at least a predetermined length. The position of the lever 52 depresses the button 64 to produce a signal that has a first value when the button is not depressed and has a second value when the button is depressed. In moving from the first position to the second position, the detector 50 depresses the button 64, causing a change in the electrical circuit that depends on whether the button 64 is depressed or not. Thus, when short fasteners 20 are being used, the signal has the first value, but if the fasteners are long, the signal changes to the second value.

It is to be understood that fastener length is not the only factor that determines the power required to fully drive the fastener 20 into the workpiece 32 (FIG. 1). In this discussion, a full power and a reduced power of approximately 50% of full power are discussed for simplicity. However, it is to be understood that many other power levels are suitable for use in this invention, either. as replacement for or in addition to those disclosed above. Additional power is needed when driving fasteners 20 into hard woods or pressure treated wood compared to soft wood. Some fasteners 20, such as ringed nails, require more power to drive. It is contemplated that the distinction between the power generated at full power and the power generated at one or more reduced power settings is dependent on the application for which the tool is intended and the materials to be used. Use of a continuous, but not necessarily linear, power reduction is also contemplated.

It is contemplated that the use of some fastener types will not necessitate varying the power output from the tool as the fastener length changes. In this case, it is contemplated that magazines 36 for this particular fastener type will not have a detector, and the magazine will have a solid panel that holds the button depressed at all times.

Once the desired reduced power level is chosen as discussed above, a fan speed is determined to produce the reduced power level. Power varies directly, but not necessarily linearly, with fan speed until full power is reached. When there is complete mixing of the air and fuel and the spent combustion gases are essentially completely evacuated from the combustion chamber 16 following combustion, increasing the fan speed generates little or no significant increase in power. The fan speed changes somewhat as the battery discharges. One average reduced fan speed is suitable for use over the whole battery cycle, or, preferably, the fan speed can fluctuate with the battery charge.

Referring back to FIGS. 1 and 2, the fuel and the air are added to the combustion chamber 16 in an appropriate ratio prior to combustion when the workpiece contact element 22 is engaged upon the workpiece 32 and the tool 10 is depressed prior to firing. The fuel is supplied to the tool 10 from the fuel cell 38, and then flows to a metering valve (not shown), through a fuel line (not shown) and into the combustion chamber 16. The fan 41, powered by the fan motor 12, generally located on a side of the combustion chamber 16 opposite the driver blade 40, draws air in and promotes turbulence. When the combustion chamber 16 is closed, turbulence mixes the gases contained therein, encouraging them to burn more efficiently. Continued movement due to momentum of the fluids during combustion propagates the flame front more quickly. Thus, low fan speeds, after engagement of the workpiece contact element 22, while the fuel and air are being mixed, but prior to combustion, reduce the primary power from the combustion chamber 16 by reducing the efficiency of combustion.

Following combustion, however, it is important to evacuate the spent combustion gases from the combustion chamber 16. Immediately following combustion, the fan speed is returned to full power for an evacuation period in preparation for the subsequent cycle of mixing and combusting of fuel. Preferably the evacuation period is from one to about five seconds in length, however, a wide range in the evacuation periods is contemplated. The evacuation period need not be a fixed length, but can last until the subsequent engagement of the workpiece contact element 22. One embodiment of the invention utilizes an evacuation period between one and three seconds.

Still referring to FIG. 2, quick reduction in speed of the fan 41 is accomplished using an optional braking system 84. Any method of shorting the fan motor 12 is contemplated for use as the braking system 84. One embodiment of the braking system 84 includes a transistor 86 wired across the fan motor 12 that shorts the motor when the transistor is activated. Selection of the appropriate transistor 86 will be obvious to those skilled in the art. In place of the transistor 86, a relay (not shown) could also be used to short the fan motor 12.

It is also contemplated that the length of the evacuation period not be used to slow the work pace of the user. If the workpiece contact element 22 is engaged upon the workpiece 32 prior to the expiration of the evacuation period, the braking system 84 is used to immediately reduce the fan speed after a shortened evacuation period.

Once the fan 41 reaches the desired speed, the speed is maintained at a lower level by reducing power to the fan motor 12. Any method of reducing power to a DC motor is suitable, including reduction in the voltage or pulsing power to the motor, turning it on and off in rapid bursts to achieve the average desired fan speed. Use of resistance to alter the fan speed is contemplated, by selection of two or more parallel resistances. Pulse-width modulation of the battery voltage is the preferred method of maintaining the low speed.

If, as preferred, the controller 82 is an electronic microcontroller, execution of a software program stored in the microcontroller is one way of varying in the fan speed based on the signal, applying the braking system 84 and modulating the power to the fan 41. The use of microcontrollers 82 is well known to artisans for such uses. The power to the fan motor 12 is output from the microcontroller 82, while information as to the fan speed is input to the microcontroller from an Analog to Digital Converter ("ADC") 88. The ADC 88 is preferably built into the controller 82, but use of a stand alone ADC is also contemplated.

A set of simple instructions in the form of programming in the microcontroller 82, directs the microcontroller how and when to vary the power to the fan 41. A discussion of one possible instruction set is discussed below to exemplify one embodiment of this control system, however, it is to be understood that many such instruction sets are possible, and many variations in this control scheme will be obvious to those skilled in the art of designing control systems. The exemplary control system disclosed below varies the power duty cycle based on the battery voltage and includes the optional braking system 84. Numerical values are provided, such as the fan speed, times and frequencies, are given as an example only and are not meant to limit the invention. The number, size and shape of fan blades 89 (FIG. 1) will contribute to the number of revolutions per minute necessary to produce a given turbulence and the time needed to increase or reduce fan speed. The size and shape of the combustion chamber 16 and the amount of fuel used per charge determines how much turbulence is needed to evacuate the combustion chamber 16. The exact electronics of the microcontroller 82 affects the frequency of the pulse width modulation.

Continuing to refer to FIG. 2, the microcontroller 82 of this embodiment has internal components for the analog to digital converter ("ADC") 88 and Pulse Speed Width modulated output. Adjusting the duty cycle of the PWM drive motor controls the fan speed. PWM output runs at 7843 Hz (127.5 $\mu$S) and can be adjusted in 0.5 $\mu$S (0.4%) steps. The PWM duty cycle is increased as the battery voltage goes decreases to maintain a constant fan speed. Target PWM output is 5.5 $\mu$S for 3000 RPM and 6.0V or 2.0 $\mu$S for 1500 RPM at 6.0V.

Speed of the motor 12 is sensed by turning off power to the motor and measuring the voltage generated by the motor using the ADC 88. A target voltage is the voltage read by the ADC 88 when the fan 41 is rotating at the target speed to achieve the desired reduced power setting. The target motor voltage in this embodiment is 1.4V for 3000 RPM or 0.7 V for 1500 RPM. During start and braking, a lower motor voltage target is used to compensate for overshoot on start up and undershoot on braking.

When starting the fan motor 12 in slow speed from a stop, nominal pulse width modulated duty cycle is calculated based on the battery voltage. DC power is applied to the motor for 12 mS. If the motor voltage is under 20% of the battery power, the motor is shorted and operation is halted. Thereafter, a 4 mS testing loop begins whereby the power to the fan 41 is turned off for 165$\mu$ and the motor voltage is read from the ADC 88. If the motor voltage is greater than or equal to the target voltage, then this loop is exited, otherwise DC power is restored to the motor and another iteration of the loop begins. When the target voltage has been reached, pulse width modulation begins using the duty cycle calculated based on the battery voltage.

Optionally, there is a first shot delay time within which the tool 10 is normally fired. There is an optional provision in the testing loop to stall the fan 41 and halt operation if the first shot delay time is reached before the fan reaches the target speed. This is a safety feature that shuts down operation if the fan 41 does not begin turning for any reason.

Referring again to FIGS. 1 and 2, engagement of the workpiece contact element 22 depresses an interlock switch 90 that prevents fuel gas from being introduced into the combustion chamber 16 and preventing firing of the fastener 20 unless the tool 10 is in contact with the workpiece 32. When the interlock switch 90 is depressed far enough, it triggers the introduction of fuel gas into the combustion chamber 16, and mixing of the fuel and air begins. Engagement of the interlock switch 90 is a convenient method of triggering reduction in the fan speed if the sensor 64 is released, indicating that reduced power is advantageous.

While the fan 41 is running at the reduced speed, the fan speed is checked every 246 mS to by the controller 82. To check the speed, the power output to the motor 12 is turned off, and the voltage of the motor 12 is sampled using the ADC 88. If the motor voltage is less than 5% of the battery capacity, the motor 12 is stalled and operation is halted. If the ADC 88 reading is within two counts of the target voltage, there is no change in the duty cycle. However, if the ADC 88 reading is more than two counts above or below the target value, the duty cycle is increased or decreased, as appropriate, to bring the fan motor speed toward the target value. Following any needed adjustments, power output from the, controller 82 to the motor 12 is resumed.

When the fan speed is reduced from full speed to the reduced speed, the optional braking system 84 is employed. The fan motor 12 is turned off, and the PWM duty cycle is calculated based on the reduced fan speed. The brake transistor 86 is activated for 160 mS, shorting the fan motor 12. A second testing loop is employed to determine when the target brake voltage has been reached. Every 4 mS, the brake transistor 86 is turned off for 165 mS, and then the motor voltage is read using the ADC 88. If the motor voltage is less than the target brake voltage, the controller 82 exits this loop, otherwise, the brake transistor 86 is turned on again and another iteration of the loop begins. Optionally, there is a time limit to end the loop if the target motor voltage has not been reached within a reasonable time. After the target motor voltage has been reached, the PWM motor output begins using the nominal PWM duty cycle.

Referring now to FIGS. 1, 3, 7 and 8, when using fasteners 20 that benefit from precise placement in the workpiece 32, such as when the metal bracket 44 with the openings 46 are used, the workpiece contact element 22 has a housing 91, a swiveling probe 92 and a support 93 for a pivot pin 94. Swiveling of the probe 92 about the pivot pin 94 allows it to pivot relative to the housing 91 along a radius from the longitudinal axis of the channel 34. The probe 92 depends from the workpiece contact element 22, and has a tip 96 engagable with the workpiece 32, and a stop surface 98 (FIG. 3). A trough 99 blocks a portion of the channel 34, limiting side-to-side motion of the fastener 32 as it moves through the channel. The tip 96 has a groove 100 to guide the fasteners 20 into the workpiece 32. Insertion of the tip 96 into one of the openings 46 and depression of the tool 10 engages the workpiece contact element 22.

Upon firing of the tool 10, the fastener 20 exits the channel 34 and contacts the groove 100 of the probe 92. The lower end 80 of the fastener 20 (FIG. 4) travels down the groove 100 and into the opening 46 in the workpiece 32 immediately beside the position where the probe 92 is located.

As the fastener 20 enters the workpiece 32, it pushes the probe 92 out of the opening 46, allowing the head of the fastener 20 to pass the position where the probe was located without jamming. When the probe 92 is pushed out of the opening 46, the swiveling probe 92 pivots about the pivot pin 94 until the stop surface 98 contacts the workpiece contact element 22, limiting movement of the rotating arm. Motion of the probe tip 96 is limited along a radius from a longitudinal axis of the channel 34. The pivotable probe 92 preferred for use with this invention is disclosed in U.S. Pat. No. 5,452,835 to Shkolnikov, herein incorporated by reference.

Figure 9:
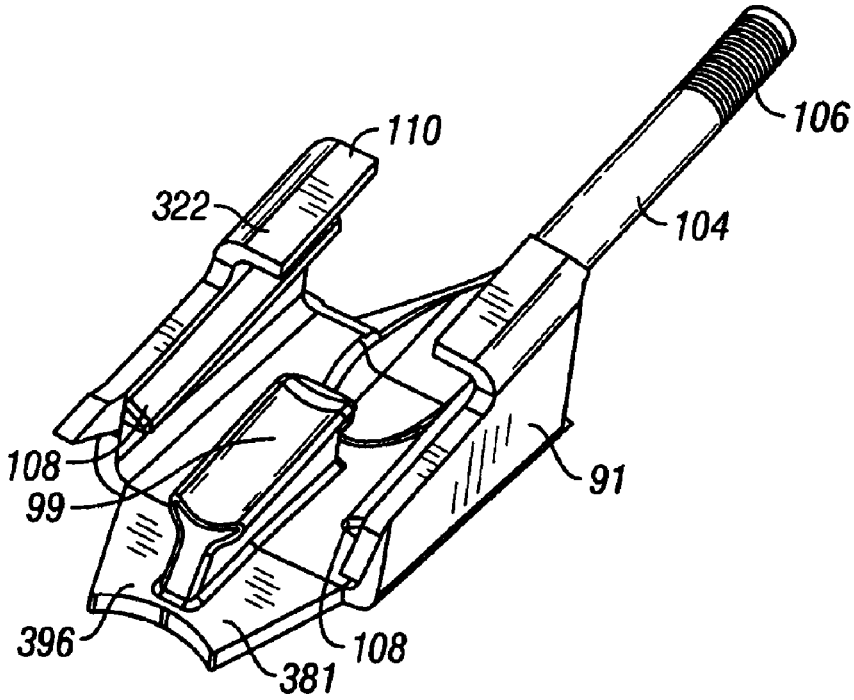
FIG. 9 is a bottom perspective view of an alternate embodiment of the workpiece contact element with a fixed shoe.

An alternate embodiment of the workpiece contact element 322, is shown in FIGS. 1 and 9, and is used for general applications. This workpiece contact element 322 does not have the pivotable probe 92, the support 93 or pivot pin 94, but rather has a fixed foot 381. At the end of the workpiece contact element 322 is a tip 396, which is set radially outwardly from the channel 34 to allow the head of the fastener 20 to pass by without jamming.

The workpiece contact element 22 has been made easily interchangeable in the tool 10 through its engagement with the threadable adjustable mechanism 24. A first alignment mechanism 102 (FIG. 1) on the nosepiece 26 is configured for engagement with the workpiece contact element 22. One embodiment of the threadable adjustable mechanism 24 is a threaded adjusting barrel member 103 on the nosepiece 26. A threaded member 104, such as a screw, extends from the workpiece contact element 22 diametrically opposite the probe 92 and engages with the threadable adjustable mechanism 24. The barrel 103 of the threadable adjustable mechanism 24 is rotatable upon engagement with threads 106 of the threaded member 104. When the threaded member 104 is aligned with the threadable adjustable mechanism 24 and the barrel 103 is rotated, the rotational motion is converted to linear motion of the workpiece contact element 22, allowing the workpiece contact element 22 to be securely attached to the nosepiece 26 at an appropriate height.

The workpiece contact element 22 also includes a second alignment structure 108 configured for slidingly engaging the first alignment mechanism 102 on the nosepiece 26. Any first and second alignment structure 102, 108 is contemplated for maintaining alignment between the workpiece contact element 22 and the nosepiece 26 after numerous firings of the tool 10. Forces generated by movement of the probe 92 radially away from the channel 34, and the general recoil of the tool 10 following firing, tend to move the workpiece contact element 22 relative to the nosepiece 26. These forces will have the greatest effect when there is a large moment arm between the area where the force is applied and the area where the workpiece contact element 22 is secured, as when the threadable adjustable mechanism 24 and threaded member 104 are on opposite sides of the workpiece contact element 22 from the probe 92. Preferably, the first and second alignment structures 102, 108 are a tongue and groove, a boss and a cover, a pin and a channel, a pair of abutting shoulders, a capturing system or any other system for maintaining alignment between the nosepiece 26 and the workpiece contact element 22. It is not important which portion of the alignment structure resides on the nosepiece 26 and which portion resides on the workpiece contact element 22. In this preferred embodiment, the first alignment mechanism 102 is a groove on the nosepiece 26 and the second alignment structure 108 is a tongue on the workpiece contact element 22.

This preferred embodiment uses a second alignment mechanism to further limit motion of the workpiece contact element 22 relative to the nosepiece 26 when the tool 10 is fired. At least one tab 110 on the housing 91 wraps around to enclose and capture the nosepiece 26, sliding over it as the workpiece contact element 22 is installed.

Initialization of the threaded member 104 into the threadable adjustable mechanism 24 places the tongue 108 below, but in registry with the groove 102. The preferably two tabs 110 are also aligned to slidingly capture the nosepiece 26. As the threaded adjusting mechanism 24 is turned, the threaded member 104 is drawn upward, so that the probe 92 approaches the exit of the channel 34, the nosepiece 26 is received by the housing 91 and tabs 110 and the tongue 108 approaches the groove 102. Continued rotation of the barrel 103 draws the tongue 108 into the groove 102. This mounting mechanism holds the workpiece contact element 22 securely in place, horizontal motion being severely limited by the tongue 108 and the groove 102, as well as the tabs 110, while vertical motion in limited by the engagement of the threaded member 104 in the threaded adjusting mechanism 24.

The relationship between all elements of this invention is understood when converting the tool 10 from use of the first type fastener 20 to the second type fastener.

It is to be understood that changing of the workpiece contact element 22 and the magazine 36 can be done in any order.

Figure 7:
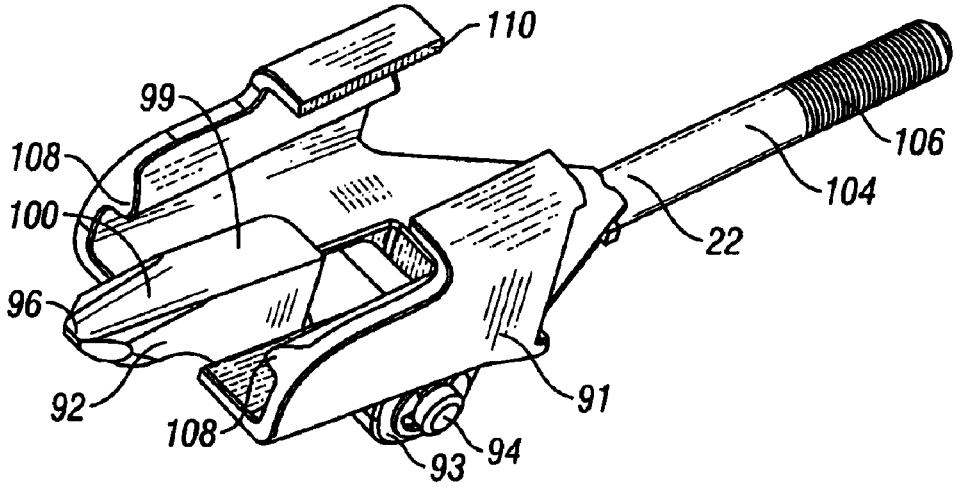
FIG. 7 is a bottom perspective view of the workpiece contact element.
Figure 8:
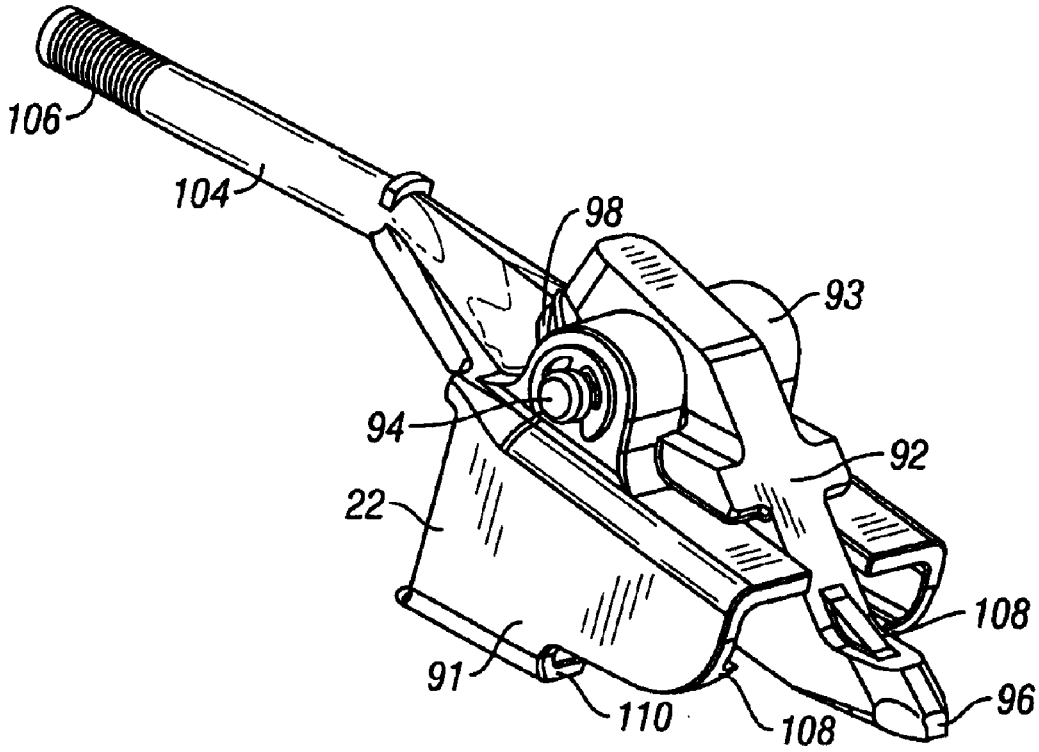
FIG. 8 is a top perspective view of the workpiece contact element.

Referring to FIGS. 1, 3 and 7, the alternate workpiece contact element 322, is removed from the tool 10 by turning the barrel 103 of the threadable adjustable mechanism 24 in a direction to lower and eventually disengage the threaded member 104. After removal of the alternate workpiece contact element 322, the workpiece contact element 22 with the probe 92 is placed with the threaded member 104 aligned in the threadable adjustable mechanism 24 and the adjusting mechanism is turned to engage the threads 106. Additional turning of the adjusting mechanism 24 draws the workpiece contact element 22 upward, capturing the nosepiece 26 with the tabs 110 and engaging the tongue 108 in the groove 102.

Now referring to FIGS. 4 and 5, prior to installation of the magazine 36 of this invention, the second type of the fasteners 20 are loaded into the magazine. As the fasteners 20 move through the interior of the magazine 36, the fasteners pass the detector 50. If the long fasteners 20 are loaded into the magazine 36, they pass over the actuating arm 60, but are pressed against the positioning face 72 of the sensing arm 66, causing it to rotate about the pivot pin 54. Rotation of the sensing arm 66 in direction A causes the actuating arm 60 to rotate in direction B, depressing the button 64. As soon as the button 64 is depressed, the signal to the controller 82 (FIG. 2) tells it to maintain full power during firing.

Referring now to FIGS. 2 and 4, if short fasteners 20 are loaded, the detector 50 does not move due to the length of the fasteners and the button 64 is not depressed. The signal to the controller 82 initiates steps to reduce power to the fan 41 while the air and fuel are being mixed in the combustion chamber 16. As the fan 41 starts up, the controller 82 applies power to the fan 41 in short bursts. Between the bursts, the controller 82 reads the ADC 88 to determine the voltage of the motor 12, thereby determining the present speed of the fan. If the fan 41 has not reached the target speed, the controller 82 again applies power and checks the fan speed. When the fan 41 attains the target speed, it is maintained at that speed by the pulse width modulation of the power to the fan until the tool 10 is fired.

Following firing, the fan 41 is returned to full power to evacuate the combustion gases from the combustion chamber 16. The fan 41 is held at full power for up to 5 seconds, then the fan is reduced to low speed. If the workpiece contact element 22 is engaged prior to reduction of fan speed, the braking system 84 is immediately engaged to slow the fan speed to the target speed.

Referring to FIGS. 1, 2 and 4, a method of driving the fasteners 20 into the workpiece 32 begins by passing the fasteners 20 past the detector 50 in the magazine 36. The detector 50 identifies the length of the fastener 20 and activates the sensor 64 to produce or change a signal. In one embodiment, the detector 50 is biased in the first position, but rotates to a second position if the fasteners 20 are at least a predetermined length. Rotation of the lever 52 depresses a button 64 when the lever moves from the first position to the second position. The sensor 64 is produced having a first value when the button is not depressed and the signal is a second value when the button 64 is depressed. After passing the detector, the fasteners 20 are urged through the magazine 36 to the channel 34.

Pressing the tool 10 to the workpiece 32 engages the workpiece contact element 22, causing fuel to be introduced into the combustion chamber 16. The primary power from the combustion chamber 16 is varied in relation to the signal, causing the driving of the fastener 20 into the workpiece 32 at a power relative to the length of the fastener. Following combustion of the fuel, the primary power is returned to full power and purging combustion gases from the combustion chamber.

Variation in the primary power can be caused by varying the power to a fan 41 from a secondary power source 42, changing the speed of the fan and creating turbulence in the vicinity of a combustion chamber 16. The power to the fan 41 is suitably varied by executing programming with an electronic controller 82. The programming is an instruction set that includes reducing the speed of the fan 41, maintaining the reduced speed until the driving of the fastener 20 and returning the fan to full speed following the driving of the fastener.

Varying of the fan speed suitably includes additional options. The braking system 84 is optionally applied to the fan 41, such as activating the transistor 86 wired across the fan motor to short it. Maintaining the reduced fan speed is done by modulating pulses of secondary power to the fan 41, by reducing the voltage or by selecting between a plurality of selectively grounded resistances, by use of photoelectric switches, or by mechanical linkages. Preferably, the modulating step is adjusted as the battery 42 is discharged.

While a particular embodiment of the present system for an improved positioning system and fastener supply for a power tool has been shown and described, it will be appreciated by those skilled in the art that changes and modifications may be made thereto without departing from the invention in its broader aspects and as set forth in the following claims.

What is claimed is:

1. A tool for driving fasteners into a workpiece, including a housing, a nosepiece at least partially defining a channel through which fasteners are expelled, and a fastener supply attachable to said tool and supplying the fasteners to the channel, comprising:

a sensor held by said housing; and a detector within the fastener supply configured to sense the length of the fasteners and communicate the length to said sensor.

2. The tool of claim 1, wherein said detector is a mechanical detector.

3. The tool of claim 2, wherein said detector comprises a lever that pivots about a point in response to the fastener length.

4. The tool of claim 3, wherein said lever further comprises an actuating arm including an offset plate, a sensing arm including a positioning face, said actuating arm, said offset plate, said sensing arm and said positioning face being configured such that all of the fasteners pass over said actuating arm, but wherein the fasteners of at least a predetermined length push against said positioning face pivoting said sensing arm, pivoting said lever, moving said actuating arm and causing said offset plate to activate said sensor.

5. The tool of claim 1 further comprising:

a first means for alignment on said nosepiece;

a second means for alignment on said workpiece contact element that engages said first means for alignment to maintain alignment between said workpiece contact element and said nosepiece;

a threaded adjusting member on said workpiece contact element;

a threadable adjustable mechanism on said nosepiece configured and arranged to receive said threaded adjusting member, such that movement of said workpiece contact element due to rotation of said threadable adjustable mechanism causes said first alignment means to engage said second alignment means.

6. The tool of claim 5, wherein said first alignment means and said second alignment means comprise a tongue and groove.

7. An interchangeable fastener supply device for supplying fasteners to a tool having a sensor, comprising:

a fastener supply device configured for being removably attachable to the tool; and a detector held within said fastener supply device that is configured for sensing the length of the fasteners in said fastener supply device and for providing an indication of the length to the sensor.

8. The fastener supply device of claim 7, wherein said detector is a mechanical detector.

9. The fastener supply device of claim 7, wherein said detector comprises a lever configured to pivot selectively, or to varying degrees, based on the length of the fastener.

10. In conjunction with a tool having a fastener supply device configured to supply fasteners, a sensor configured for receiving a signal indicating the length of fasteners in the fastener supply device, and a nosepiece at least partially defining a channel through which the fasteners are expelled, an adaptation kit for adapting the tool from a first fastener type to a second fastener type for use with a workpiece having openings, comprising:

(a) an interchangeable workpiece contact element; and (b) a fastener supply device removably attachable to the tool, including a detector configured to sense the length of the fasteners in the fastener supply and communicate the length to the sensor, said device including a supply of fasteners configured for use with said workpiece contact element.

11. The adaptation kit of claim 10 wherein said detector is a lever configured to pivot about a point in response to the fastener length.

12. The adaptation kit of claim 11 wherein said lever arm further comprises an actuating arm including an offset plate, a sensing arm including a positioning face, said actuating arm, said offset plate, said sensing arm and said positioning face being configured such that all of the fasteners pass over said actuating arm, but wherein the fasteners of at least a predetermined length push against said positioning face pivoting said sensing arm, pivoting said lever, moving said actuating arm and causing said offset plate to activate said sensor.

13. The adaptation kit of claim 10 wherein said probe further comprises a groove to guide the fastener into the opening.

14. The adaptation kit of claim 10, further comprising a threaded adjusting member, a second alignment means and a probe, said threaded adjusting member configured to engage the threadable adjustable mechanism such that movement of said workpiece contact element due to engagement of the threaded adjusting member in the threadable adjustable mechanism causes the first alignment means to engage said second alignment means.

15. The adaptation kit of claim 14 wherein the first alignment means and said second alignment means include a tongue and a groove.

16. The adaption kit of claim 14 wherein a probe depends from said workpiece contact element and pivotable along a radius from a longitudinal axis of the channel, the fastener being guided into the workpiece when said probe is inserted in the opening.

17. A method for preparing a tool to drive fasteners into a workpiece, said method comprising:

loading fasteners into a interchangeable fastener supply device;

installing said interchangeable fastener supply device onto said tool;

detecting a length of the fasteners within said fastener supply device; and communicating a signal to a sensor in the tool, said signal being based on the length.

18. The method of claim 17 wherein said detecting step further comprises exerting a force on a lever and rotating the lever if the fasteners exceed a predetermined length.

19. The method of claim 17 wherein said detecting step further comprises exerting a force on a lever and rotating the lever if the fasteners exceed a predetermined length.

20. The method of claim 17 further comprising the steps of positioning a first means for alignment on a nosepiece adjacent a second means for alignment on a workpiece contact element;

engaging a threaded adjusting member on said second workpiece contact element in a threadable adjustable mechanism on said nosepiece; and rotating said threaded adjusting member such that movement of the workpiece contact element relative to said nosepiece engages said first means for alignment with said second means for alignment.

* * * * *